US010472218B2

(12) United States Patent
Auer

(10) Patent No.: US 10,472,218 B2
(45) Date of Patent: Nov. 12, 2019

(54) DOSING DEVICE AND DOSING METHOD FOR LIQUIDS

(75) Inventor: Dirk Auer, Meerbusch (DE)

(73) Assignee: ELOPAK SYSTEMS AG, Glattbrugg (CH)

( * ) Notice: Subject to any disclaimer, the term of this patent is extended or adjusted under 35 U.S.C. 154(b) by 369 days.

(21) Appl. No.: 13/522,868

(22) PCT Filed: Jan. 26, 2011

(86) PCT No.: PCT/EP2011/051039
§ 371 (c)(1),
(2), (4) Date: Jul. 18, 2012

(87) PCT Pub. No.: WO2011/092188
PCT Pub. Date: Aug. 4, 2011

(65) Prior Publication Data

US 2012/0291898 A1 Nov. 22, 2012

(30) Foreign Application Priority Data

Jan. 27, 2010 (DE) ..... 10 2010 006 005

(51) Int. Cl.
*B67C 3/28* (2006.01)
*B65B 3/22* (2006.01)
(Continued)

(52) U.S. Cl.
CPC ..... *B67C 3/286* (2013.01); *B65B 3/22* (2013.01); *B65B 39/004* (2013.01); *B67C 2003/2671* (2013.01); *Y10T 137/88038* (2015.04)

(58) Field of Classification Search
CPC ..... B65B 3/22; B65B 39/004; B65B 39/00; B65B 39/001; B65B 2039/009;
(Continued)

(56) References Cited

U.S. PATENT DOCUMENTS 2,201,752 A * 5/1940 Winberg ..... B65B 39/004 137/630.14
2,392,741 A * 1/1946 Hurlburt ..... 137/630.22
(Continued)

FOREIGN PATENT DOCUMENTS

DE 2209772 9/1973
DE 2246176 4/1974
(Continued)

OTHER PUBLICATIONS

Raw Machine Translation of DE2209772 [Kestermann, Pub. on Sep. 13, 1973] provided by the EPO.*
(Continued)

*Primary Examiner* — Reinaldo Sanchez-Medina
*Assistant Examiner* — David Colon-Morales
(74) *Attorney, Agent, or Firm* — Lucas & Mercanti, LLP

(57) ABSTRACT

The invention relates to a dosing device having an inlet for a liquid to be delivered to a container as a dose, in particular a beverage. The device comprises a valve seat, a sealing element interacting with the valve seat and an outlet for the dose of the liquid. In order to reduce foam build-up upon delivering the liquid into the container, according to the invention the sealing element can be moved to a first and a second opening position, wherein, in the second opening position, the flow cross-section area between the valve seat and the sealing element is larger than in the first opening position. In addition, the invention relates to a dosing method comprising the supplying of a liquid to a valve which is moved to a first and second opening position.

9 Claims, 2 Drawing Sheets

(51) Int. Cl.
*B65B 39/00* (2006.01)
*B67C 3/26* (2006.01)

(58) Field of Classification Search
CPC ... B67C 3/286; B67C 2003/2671; B67C 3/28; F16K 1/526; F16K 1/52; Y10T 137/88038; Y10T 137/87016; Y10T 137/8704; Y10T 137/86976
USPC .... 137/600, 599.01, 601.01, 601.12, 630.14, 137/630.22, 630.19; 251/118, 127, 205; 141/255, 285, 286, 302, 372; 222/425, 222/434, 440, 514, 518
See application file for complete search history.

(56) References Cited

U.S. PATENT DOCUMENTS 2,659,386 A * 11/1953 Hallett et al. ..... 137/630.22
2,693,825 A * 11/1954 Carr ..... 137/630.15
3,415,294 A * 12/1968 Kelly ..... B65B 3/22 141/1
3,884,277 A 5/1975 Rademacher et al.
4,512,379 A * 4/1985 Hennig ..... 141/286
4,672,203 A * 6/1987 Holkeboer ..... F16K 39/024 137/630.15
4,685,598 A * 8/1987 Nezworski ..... 222/400.7
4,903,740 A * 2/1990 Corniea et al. ..... 141/1
5,119,859 A * 6/1992 Sato ..... F01D 17/145 137/630.13
5,145,008 A 9/1992 Yun
5,335,862 A * 8/1994 Esper ..... 239/570
5,450,877 A * 9/1995 Graffin ..... F16K 31/086 137/630.14
5,676,344 A * 10/1997 Graffin ..... B65B 39/004 251/65
5,816,456 A * 10/1998 Graffin ..... B65B 39/004 222/559
5,954,086 A * 9/1999 Ronchi ..... B65B 39/004 137/244
6,375,050 B1 * 4/2002 Gruson ..... B67C 3/2608 137/614.11
6,546,970 B2 * 4/2003 Gatteschi ..... B65B 39/004 141/100
6,729,351 B2 * 5/2004 Bircann et al. ..... 137/630.14
6,745,794 B2 * 6/2004 Gajewski ..... 137/630
7,347,221 B2 * 3/2008 Berger et al. ..... 137/628
8,312,902 B2 * 11/2012 Mengibar Rivas ..... B67C 3/281 141/192
9,233,821 B2 * 1/2016 Huitorel ..... B67C 3/286
2002/0027211 A1 * 3/2002 Kajitani ..... 251/63.6
2005/0198921 A1 * 9/2005 Clusserath ..... 53/136.1
2006/0006356 A1 * 1/2006 Hansson ..... F16K 1/36 251/264
2008/0072995 A1 * 3/2008 Jenne ..... 141/311 A

FOREIGN PATENT DOCUMENTS

| | | |
|---|---|---|
| EP | 0278560 | 8/1988 |
| EP | 0754144 | 1/1997 |
| EP | 1207108 | 5/2002 |
| EP | 1588948 | 10/2005 |
| GB | 245251 | 1/1926 |
| GB | 701144 | * 12/1953 |
| GB | 2308174 | 6/1997 |
| WO | WO 03037779 | 5/2003 |
| WO | WO 2006091159 | 8/2006 |

OTHER PUBLICATIONS

Raw Machine Translation of DE2246176 [Mueller, Pub. on Apr. 11, 1974] provided by the EPO.*

* cited by examiner

DOSING DEVICE AND DOSING METHOD FOR LIQUIDS

CROSS-REFERENCE TO RELATED APPLICATIONS

This is a U.S. national stage of application No. PCT/EP2011/051039 filed 26 Jan. 2011. Priority is claimed on German Application No. 10 2010 006 005.4 filed 27 Jan. 27, 2010, the content of which is incorporated herein by reference in its entirety.

BACKGROUND OF THE INVENTION

1. Field of the Invention

The invention pertains to a liquid flow control device, especially a metering device, with an inlet for a liquid to be dispensed, especially as a metered quantity, the device comprising a valve seat, a sealing element cooperating with the valve seat, and an outlet for the liquid. The invention also pertains to a method, especially a metering method, for dispensing the liquid.

2. Description of the Related Art

The above-mentioned types of metering devices and metering methods are used, for example, for the rapid filling of containers, especially packages made of laminated material (cardboard with a PE coating), with a liquid (milk and juices). When these containers are being filled with a liquid, care must be taken to minimize the amount of foam produced. This is important, because, after they have been filled, the packages of laminated material are folded over at the top and then sealed by welding. If foam has formed, the inside surfaces of the upper edge of the package, which will later form the welded seam, will be wet. Leaks can therefore result when the edges of the package are welded, because the wetted areas prevent the PE coating from bonding properly.

If a container is being filled with a liquid containing vitamin C, the amount of air present in the headspace of the filled package must be small as possible. The air would react with the vitamin C, thus making it impossible to store the liquid in the sealed package for long periods without degradation. If foam were to form, however, it would be extremely difficult to obtain a headspace free of air.

For the reasons given above, there is therefore the need to avoid the formation of foam as completely as possible when containers are being filled with certain liquids.

If the liquid is added directly to a container by gravity, the impact of the liquid on the bottom of the container unavoidably creates foam. Before the stream of liquid even hits the bottom, vortices and constrictions develop in it, which prevent the stream from flowing calmly.

To reduce the formation of foam, tubular outlets have been developed, which create an almost completely laminar flow in the filling jet. These outflow pieces comprise several thin tubes, through which the liquid is conducted into the package. Above the outflow piece, a valve body is arranged, which can interrupt or release the infeed of the liquid from the supply tank and thus stop or restart the filling jet. It has been found, however, that, as a result of the friction of the liquid against the inside walls of the tubes, the individual jets are still too agitated.

An elaboration consists in arranging a cylindrical body with fine bores, the axes of which are parallel to each other, at the outlet of a metering device of the general type in question. In the constricted space of the bores, hardly any vortices form, which means that the liquid can flow with almost no agitation at all. A metering device with this type of cylindrical body is described in, for example, EP 0 754 144 B1. Nevertheless, when liquids are metered into packages, the known measures are often still incapable of suppressing foam formation sufficiently.

To prevent the formation of foam in a liquid being used to fill containers, EP 1588948 A1 discloses a liquid filling nozzle with an inlet for a liquid. The nozzle comprises a valve seat, a conical sealing element cooperating with the valve seat, and an outlet for the liquid. The sealing element can be brought into a first and a second open position, wherein the cross-sectional flow area between the valve seat and the sealing element and the angle at which the liquid is dispensed into the container to be filled in the one open position are different from those in the other open position.

GB 2308174 A discloses a liquid dispensing valve for filling containers with precise quantities of liquid. In a cylindrical housing with an inlet for the liquid, a flood piston, a dribble piston, and a drip piston are arranged concentrically from the outside to the inside; the pistons seal off the outlet of the liquid dispensing valve. The inner drip piston is connected by a piston rod to a compressed-air cylinder, which serves as a drive. A first spring is installed between the dribble piston and the drip piston and arranged concentrically to them. A second spring is installed between the dribble piston and the flood piston surrounding it. Finally, the flood piston is supported by way of a third spring against the housing of the liquid dispensing valve. In the Area of the outlet opening, the pistons have walls sections with similar angles of inclination. By means of the piston rod, the pistons, which are connected to each other by springs, can be opened and closed as a function of the stroke of the piston rod. To fill a container with liquid, first the outer flood piston and the two pistons arranged inside it, namely, the dribble piston and the drip piston, are all opened completely, so that most of the liquid (approximately 95%) enters the container through the ring-shaped gap between the outer flood piston and the outlet, which serves as the valve seat. To add the remainder of the liquid to the container, the liquid dispensing valve is closed, and then the piston rod is raised to such an extent that either only the central drip piston or both the drip piston and the dribble piston surrounding it are raised, so that the remaining quantity of the liquid drips or dribbles into the container.

DE 22 09 772 A discloses a liquid flow control device with an inlet for a liquid such paint. The liquid flow control device comprises a sealing piece arranged movably in a filling head; the sealing piece has a valve plunger, which can be brought to rest against a conical circumferential surface on the outflow nozzle of the filling head. Inside the sealing piece there is a valve rod, which can be brought to rest against the valve seat of a central outflow opening at the bottom of the sealing piece. The valve rod can be moved back and forth in the sealing piece by means of a piston plate, which is spring-loaded from above and which can be actuated from below for certain periods of time by pressing means. The sealing piece first opens the outlet of the outflow nozzle to the maximum degree. After most of the desired quantity of liquid has run into the vessel to be filled, the valve plunger is lowered to such an extent that the circumferential surface of the sealing piece is located a short distance away from the valve seat of the outlet, so that the liquid to be added to the container can pass through only a ring-shaped gap between the sealing piece and the valve seat. Then the sealing piece is pressed firmly onto the valve seat. At the same time, however, compressed air is used to continue to hold the valve rod in its open position against the action of the spring. Now only a small amount of the liquid to be added can flow through the central outflow opening into the vessel to be filled. As soon as the correct weight has been obtained in the vessel, the valve rod is moved immediately downward by the compression spring toward the valve seat, as a result of which the liquid feed is completely stopped.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

SUMMARY OF THE INVENTION

Proceeding from this prior art, the invention is based on the goal of creating a liquid flow control device, especially a metering device, and a liquid flow control method, especially a metering method, which more effectively reduces the formation of foam which occurs when packages are filled, especially when they are filled with metered quantities of liquid. After the liquid has been dispensed, any after-dripping of the liquid is also to be prevented by the liquid flow control device.

The goal is achieved in part on the basis of the recognition that a jet of liquid is agitated and thus foam is formed by the metering action itself. To ensure that the metered quantity always remains the same, the valve in the prior art is opened and closed abruptly. The abrupt starting and stopping of the filling jet leads to an agitated filling jet.

In detail, the goal is achieved in the case of a liquid flow control device including an inlet and an outlet; a valve seat; a sealing element cooperating with the valve seat, the sealing element being movable to a first open position and a second open position, the flow cross section between the valve seat and the sealing element in the second open position being larger than the flow cross section between the valve seat and the sealing element in the first open position, the sealing element comprising a first part and a second part that encircles at least a portion of the first part; and an outflow piece disposed at the outlet and having a plurality of passages arranged next to each other, an end surface of the outflow piece facing the sealing element forming at least part of the valve seat, wherein the first and second parts of the sealing element can be respectively positioned on orifices of said passages to close said passages, and the first and second parts being configured so that only passages closable by the first part are open in the first open position and passages closable by both the first and second parts are open in the second open position.

In terms of method, the goal is achieved by a liquid flow control method feeding a liquid to a valve; opening the valve from a closed position to a first open position; and opening the valve from the first open position to a second open position, the flow cross section of the valve in the second open position being larger than the flow cross section of the valve in the first open position, whereby the liquid is dispensed by the steps of opening, wherein the flow cross section of the valve in the first open position is encircled by an additional flow cross section of the valve in the second open position, and wherein the liquid dispensed through the valve is conducted through an outflow piece with a plurality of passages arranged next to each other.

Because the sealing element can be brought initially into a first then a second open position with different flow cross sections, a small quantity of the liquid flows initially into the container and covers the bottom. Only after the bottom of the container has been covered by the first quantity of liquid does the sealing element move into the second open position to allow the full filling jet of liquid to enter the container. Because of the staggered way in which the liquid is delivered, the splashing which would otherwise occur during the dispensing of the liquid and thus the formation of foam are reduced.

The sealing element with a first and a second open position comprises a first part and a second part, which are able to move independently of each other, wherein, in the flow direction of the liquid through the metering device, the first part is surrounded by the second part, and the parts are arranged in such a way that the opening of the first part brings the sealing element into the first open position and the opening of the second part brings the sealing element into the second open position.

To calm the jet even more effectively, according to the invention a cylindrical outflow piece with several passages arranged next to each other in the axial direction, as known in itself from, for example, EP 0 278 560 A1, is arranged at the outlet of the metering device. The preferably flat end surface of the outflow piece facing the sealing element forms at the same time at least one component of the valve seat, wherein the first and second parts of the sealing element rest with a sealing action on several orifices of the passages in the outflow piece.

The two-stage opening and closing of the sealing element, wherein initially the first part releases several passages in the center of the outflow piece and then the second part releases several openings concentric to the central openings in the outflow piece, means that the liquid is metered with very little foam and without any splashing. The first and the second parts can each be brought to rest with a sealing action on several orifices in the outflow piece.

The formation of foam is avoided by achieving the slowest possible flow rate of the liquid at the outlet of the outflow piece in conjunction with the splash-free starting and stopping of the filling process. To prevent foam, the invention takes advantage of the flow behavior of the liquid in the passages of the outflow piece:

With respect to the flow of liquid through pipes, a basic distinction is made between laminar flow and turbulent flow. In the case of laminar flow, the velocity distribution assumes a parabolic course, the maximum velocity being present along the axis of the pipe. In the case of turbulent flow, the velocity distribution is much more uniform. Whether laminar flow or turbulent flow is dominant can be determined by the Reynolds number. Re<2000 corresponds to laminar flow, whereas R>3000 corresponds to turbulent flow. The formula for determining the Reynolds number is:

$$Re=v_m \times d/\nu$$

where $v_m$=the average velocity, d=the open diameter of the pipe, and

ν=the dynamic viscosity.

The average velocity is found by dividing the volume flow rate of the liquid by the cross sectional area of the pipe. One can conduct a given volume flow rate of the liquid at the same average velocity either through a single pipe of large dimensions or through several pipes of smaller dimensions which together have the same cross-sectional area as the large pipe. When the liquid is conducted through several pipes, however, the Reynolds number obtained for the individual pipes according to the previously mentioned formula is smaller than in the case of a single large pipe. This means that it is possible to influence the flow profile during the filling process in the desired manner by changing the number of passages in the outflow piece and by adjusting the flow cross section, specifically by adjusting the diameter of those passages.

In particular during the starting phase of the filling operation, a laminar flow profile is desirable at the outlet of the passages of the outflow piece. The jet begins very gently with the parabolic form characteristic of laminar flow, which results in a gentle impact on the bottom surface of the container. So as not to lose the advantage of laminar flow, not all of the passages in the outflow piece are opened simultaneously at first during the starting phase; on the contrary, only the central passages, on the orifices of which the first part of the sealing element can be brought to rest, are opened. Then the passages surrounding the central ones, i.e., the passages on the orifices of which the second part of the sealing element can be brought to rest, are released.

The passages are then closed in the opposite order.

The flow cross sections of the passages in the outflow piece are dimensioned in such a way that, after the parts of the sealing element have made sealing contact with the orifices, capillary action prevents the liquid from running out of the individual passages. This again helps to achieve a gentler flow during the starting phase of the filling operation. When the first part is raised from the valve seat and the passages are opened, the capillary action stops. The residual liquid in the passages begins to empty out, at first simply by the force of gravity.

Simultaneously, the liquid above the sealing element flows through the released passages at an increasing rate. When the passages are closed again by the parts of the sealing element which can be brought to rest on the associated orifices, the supply of liquid to the passages is interrupted. As soon as the equilibrium of forces between the capillary forces and atmospheric pressure has become equalized again, the filling jet stops. Any after-dripping or uncontrolled emptying of the liquid after the closing of the sealing element is effectively prevented by the capillary action inside the passages in the outflow piece and by the sealing element resting with a sealing action on the orifices.

So that the diameter of the passages can be adapted to different filling tasks, especially to liquids of different viscosities and to different filling rates, the outflow piece is preferably fastened detachably to the outlet of the metering device.

So that a small quantity of the liquid can be distributed as uniformly as possible on the bottom of the container first, it is provided according to an advantageous embodiment of the metering device that a first surface of the first part and a second surface of the second part of the sealing element are opposite each other, and the surfaces are arranged in such a way that, when the first part is opened, a small ring-shaped gap is formed between the first and second parts. The flow cross section in the form of a relatively narrow ring-shaped gap which is released is considerably smaller than the flow cross section between the valve seat and the sealing element in the second open position. As a result, only a small quantity of liquid strikes the bottom of the container, and it does so uniformly and with low energy, as a result of which splashing and foaming are reduced.

A gradual increase in the intensity of the filling jet between the first and second open positions can be achieved by designing the first surface of the first part and the second surface of the second part so that the distance between them decreases in the flow direction of the liquid through the device in such a way that, during the opening of the first part, the flow cross section released in the form of the ring-shaped gap increases continuously. The gradual increase in the intensity of the filling jet thus caused prevents splashing and foaming even more effectively.

The two-part sealing element can be actuated by only a single drive if the first part is connected to a force-transmission means for opening the sealing element and the second part is connected to the first in such a way that the second part of the sealing element rests on the valve seat until the first open position is reached.

In conjunction with a flow cross section which increases continuously as the first part is being opened, controlling the velocity of the force-transmission means makes it possible to create a pressure profile for the filling jet which is adapted optimally to the specific liquid to be dispensed.

BRIEF DESCRIPTION OF THE DRAWINGS

The invention is explained in greater detail below on the basis of an exemplary embodiment of an inventive metering device.

DETAILED DESCRIPTION OF THE PREFERRED EMBODIMENTS

Figure 1:
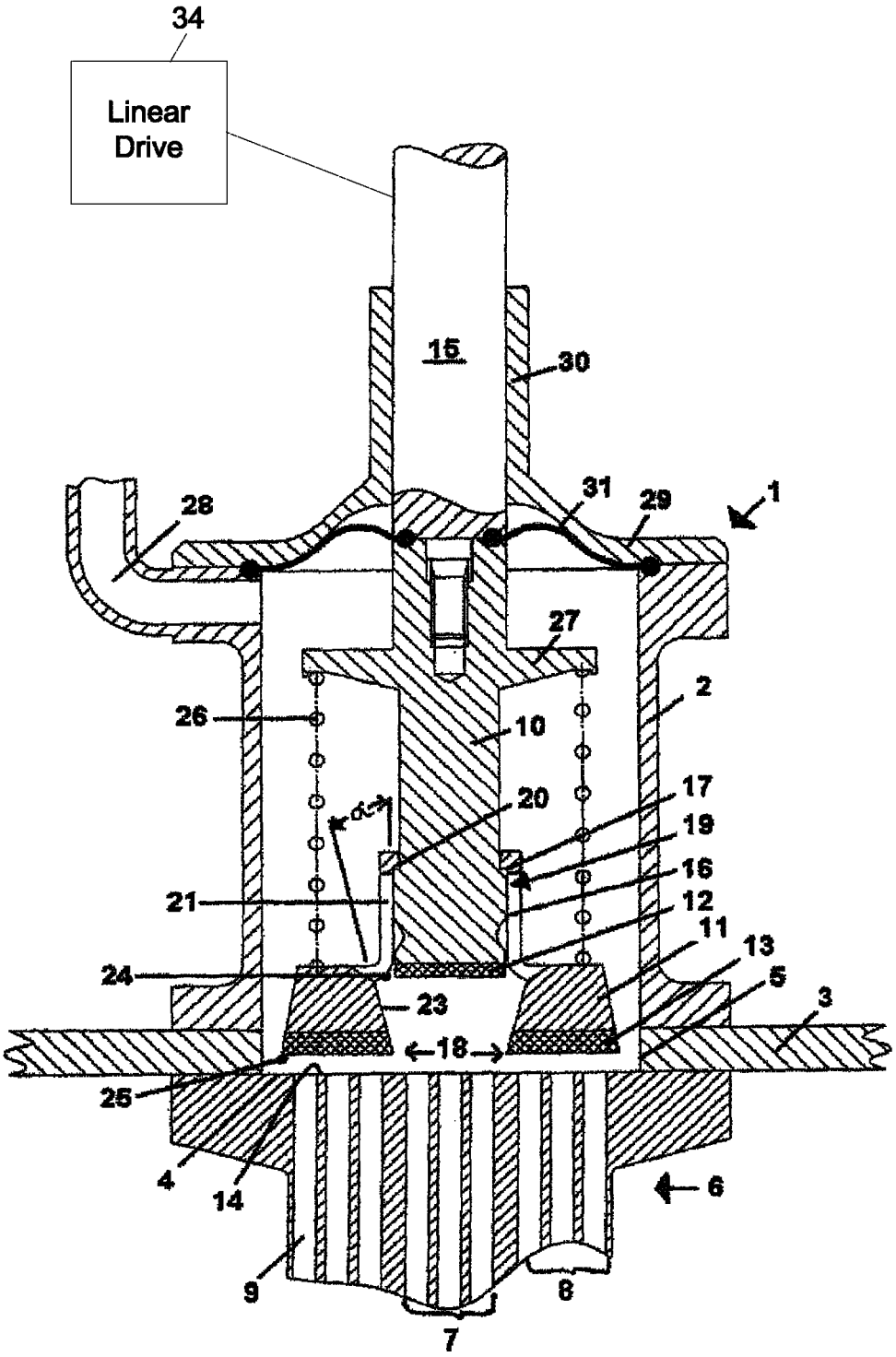
FIG. 1 shows a cross-sectional side view of an inventive metering device.

A metering device 1 comprises, in part, a valve housing 2, which is arranged on a cover plate 3 of a filling chamber. In the filling chamber (not shown), containers, especially packages of laminated material, are filled with a liquid such as juice. The outlet 4 of the metering device 1 is aligned with a passage 5 in the cover plate 3 corresponding to the cross section of the outlet. Underneath the cover plate 3, a cylindrical outflow piece 6 is arranged concentrically to the outlet 4 of the metering device. The outflow piece 6 could also, of course, be fastened indirectly to the metering device 1.

The outflow piece 6 is divided functionally into a central outflow section 7 and a peripheral outflow section 8 surrounding the central one. Both the central outflow section 7 and the peripheral outflow section 8 are formed by several cylindrical, preferably circular-cylindrical, passages 9 arranged next to each other in the axial direction of the outflow piece 6.

A two-part sealing element with freedom to move up and down is provided in the valve housing 2; this element comprises a central plunger 10 as its first part and a ring-shaped valve body 11, surrounding the plunger 10, as its second part.

The plunger 10 has a central sealing plate 12 on its end surface, and the valve body 11 has a ring-shaped sealing plate 13 on its end surface; in the closed state of the sealing element, these plates rest jointly on the top surface 14 of the outflow piece 6 with a sealing action. The top surface 14 thus forms at the same time the valve seat for the sealing element. Of course, the valve seat could also be designed as a component of the valve housing 2, such as a circumferential, inward-pointing web extending around the outlet 4, on which the outer edge of the ring-shaped sealing plate 13 is seated.

The central plunger 10 is connected to a control rod 15 for opening and closing the sealed element. The control rod 15 is connected to a linear drive 34. The ring-shaped valve body 11 is connected to the plunger 10.

Above the central sealing plate 12, the plunger 10 comprises a section designed as a driver 16; the transition of this section to the section of the plunger 10 of smaller diameter located above it forms a circumferential shoulder 17.

Around its central opening 18, the ring-shaped valve body 11 comprises a driver sleeve 19 extending upward and around the plunger 10; at its upper end, this sleeve comprises a stop 20, which cooperates with the shoulder 17. In this way, the driver sleeve 19 connects the valve body 11 to the plunger 10. The driver sleeve 19 is provided with several passages 21 around its circumference.

An upward-pointing, diverging, preferably frustum-like surface 23 of the valve body 11 is located opposite the essentially vertical, cylindrical, preferably circular-cylindrical surface of the driver 16 on the plunger 10. Between the essentially vertical surface of the driver 16 on the plunger 10 and the opposing, slanted surface 23 of the valve body 11, an acute angle $\alpha$ is formed, so that, when the plunger 10 is opened, a small ring-shaped gap 24 is created between the plunger 10 and the valve body 11. In addition, in the second open position of the metering device, which is shown in FIG. 1, a larger ring-shaped gap 25 is created between the ring-shaped sealing plate 13 of the valve body 11 and the top surface 14 of the outflow piece 6.

So that the plunger 10 and the valve body 11 are in defined positions with respect to each other in every position of the sealing element, and so that the ring-shaped sealing plate 13 adequately seals the passages 9 in the outflow piece 6, a compression spring 26 is provided, one end of which is supported on the top surface of the valve body 11, whereas the other end is supported on a spring plate 27 arranged on the upper section of the plunger 10.

Finally, the valve space formed by the valve housing 2 is provided with an inlet 28 for the liquid to be dispensed; the inlet is connected to a supply tank (not shown).

To actuate the plunger 10 and the valve body 11 attached to it, the plunger 10 is connected to the control rod 15, which is guided through a housing cover 29 with a slide guide 30. To prevent the intrusion of dirt and the escape of liquid through the slide guide 30, a membrane 31, which ensures a hermetic seal of the valve space against the slide guide 30, extends between the valve housing 2 and the plunger 10.

The way in which the metering device 1 operates is illustrated in FIGS. 2-5.

Figure 2:
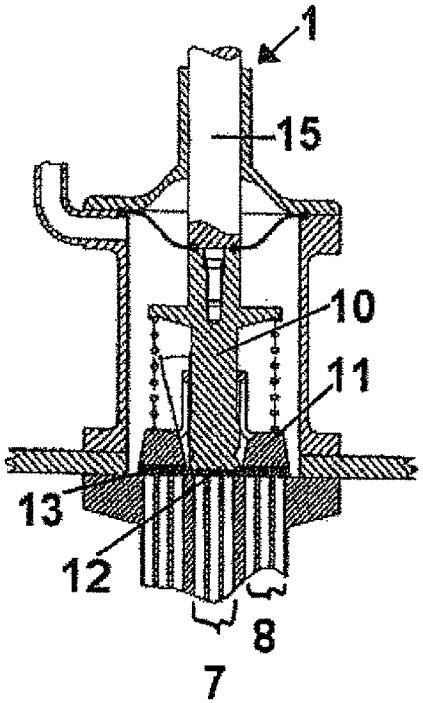

In FIG. 2, the metering device 1 is closed. The plunger 10 and the valve body 11 are both in their lower, closed positions, and thus they and their sealing plates 12, 13 form a sealing unit, which covers both the central and the peripheral outflow sections 7, 8. The liquid present in the valve space cannot flow into the container to be filled.

Figure 3:
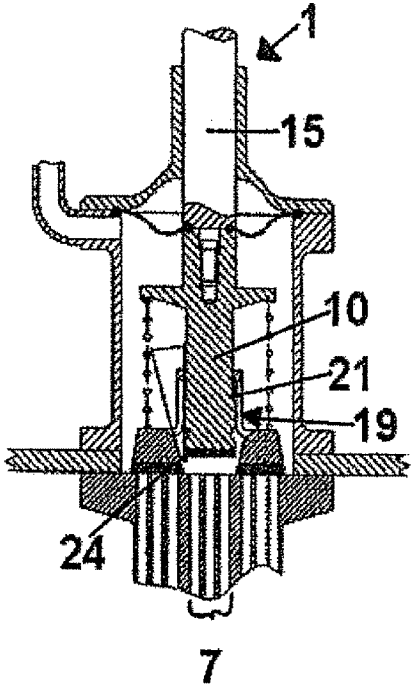

In FIG. 3, the plunger 10 is raised. Now a first, small quantity of liquid, which has been waiting at the passages 21 through the driver sleeve 19 on the plunger 10, can flow through the small ring-shaped gap 24 and then through the central outflow section 7 into the container.

Figure 4:
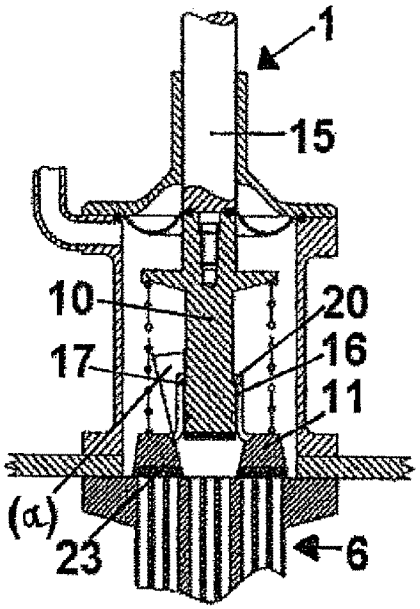

The velocity at which the plunger 10 is raised into the first open position of the sealing element shown in FIG. 4 and then lowered back down again into the closed position is preferably variable, as a result of which, in conjunction with the slanted surface 23 of the valve body 11, which forms the angle ($\alpha$), it is possible to open the outflow channels in a controlled manner and thus to reduce the pressure. This achieves the goal of minimizing the impact of the liquid on the bottom of the container at the beginning of the filling operation.

By the time the first open position is reached, the container bottom is covered with a first layer of liquid, and the shoulder 17 of the driver 16 of the plunger 10 has run up against the stop 20 on the driver sleeve 19 of the valve body 11.

Figure 5:
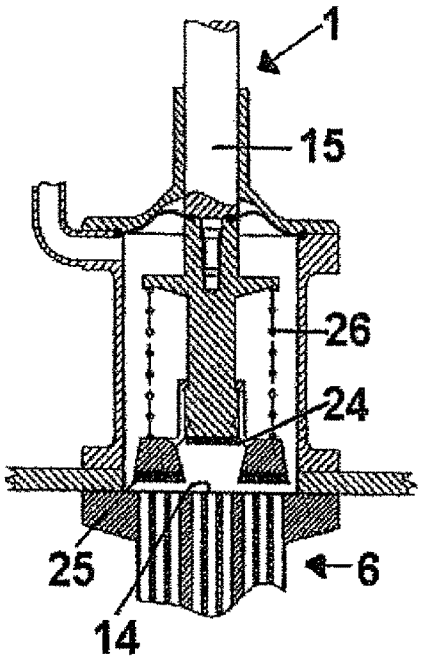
FIGS. 2-5 shows the metering device according to FIG. 1 with the two-part sealing element in different positions.

During the further course of the upward movement, the shoulder 17 of the plunger 10 carries the valve body 11 up along with it from the lower closed position into the second open position of the sealing element, shown in FIG. 5. As a result, the entire top surface 14 of the outflow piece 6 is released, so that now the intensity of the liquid flow can increase gradually to its maximum as the liquid flows through both the small ring-shaped gap 24 and the large ring-shaped gap 25 into the container. This continues until the control rod 15 moves the plunger 10 back down again.

During this downward movement, the valve body 11 by means of the compression spring 26 is pressed first onto the top surface 14 of the outflow piece 6 (FIG. 4), as a result of which the filling jet is decreased in a manner which is the reverse of that in which it was increased. During the following further downward movement of the plunger 10 into the closed position (FIG. 2), the flow rate of the liquid is continuously reduced by the plunger 10 as it moves into the central opening 18, because, as the plunger 10 moves down, the surface 23 of the small ring-shaped gap 24, which forms the boundary of the central opening 18 and is slanted at the angle ($\alpha$), becomes continuously smaller. As a result, the filling operation is completed gently and without splashing.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A liquid flow control device configured to conduct a filling operation for filling a metered quantity of liquid into a package, comprising:

an inlet and an outlet;

a valve seat;

a sealing element cooperating with the valve seat, the sealing element being movable to a first open position and a second open position, a flow cross section between the valve seat and the sealing element in the second open position being larger than the flow cross section between the valve seat and the sealing element in the first open position, the sealing element comprising a first part and a second part that encircles at least a portion of the first part, the second part having an inner surface facing an outer surface of the first part;

an outflow piece disposed at the outlet and having a plurality of passages arranged next to each other, an end surface of the outflow piece facing the sealing element forming at least part of said valve seat, wherein the first and second parts of the sealing element can be respectively positioned on orifices of said passages to close all passages of said plurality of passages in a closed position of the sealing element, and the first and second parts being configured so that passages closable by the first part are open and passages closable by the second part are closed in the first open position and passages closable by both the first and second parts are open in the second open position, the sealing element allowing a filling liquid to flow through the outflow piece and form a filling jet for the filling operation when the sealing element is not in the closed position, wherein a gap formed between the outer surface of the first part and the inner surface of the second part defines the flow cross section when the sealing element is moved from the closed position to the first open position, and a size of the flow cross section defined by the gap increases as the first part is moved toward the first open position;

a sleeve connecting the first part to the second part, the sleeve being connected at an upper portion of the inner surface of the second part that forms the gap and having a first sleeve portion that extends from the upper portion of the inner surface of the second part toward the outer surface of the first part and a second sleeve portion that extends upward from the first sleeve portion along the outer surface of the first part, wherein an upper end of the second sleeve portion has a stop that cooperates with a shoulder that extends around a circumference of the first part, and the sleeve has a plurality of sleeve passages around a circumference thereof, the sleeve passages allowing the filling liquid to flow from an outer side to an inner side of the sleeve and through the gap between the first part and the second part; and a force-transmission device connected to the first part for opening the sealing element.

2. The liquid flow control device of claim 1, wherein the gap is a ring-shaped gap.

3. The liquid flow device of claim 1, wherein the force-transmission device is connected to the first part for opening the sealing element, wherein the first part is connected to the second part such that the second part rests on the valve seat until the first opening position is reached.

4. The liquid flow device of claim 1, wherein the first part is a driver and the outer surface is a cylindrical outer surface extending vertically, the second part is a valve body and the inner surface is a frustum-like surface, and the frustum-like surface forms an acute angle $\alpha$ with the cylindrical outer surface.

5. The liquid flow device of claim 1, further comprising a linear drive controlling a velocity of the force-transmission device when moving the sealing element from the closed position to the first open position to create a pressure profile for the filling jet, the pressure profile being adapted to the filling liquid to be dispensed to minimize an impact of the liquid on a bottom of the package at a beginning of the filling operation.

6. The liquid flow device of claim 1, wherein each of the sleeve passages extends through both the first sleeve portion and the second sleeve portion.

7. The liquid flow device of claim 1, wherein the device comprises a housing defining the inlet and the outlet, and a membrane is connected between the housing and at least one of the force-transmission device and the first part of the sealing element to prevent the intrusion of dirt and escape of liquid, the membrane having a first end connected to the at least one of the force-transmission device and the first part of the sealing element and a second end connected to the housing, the first end being movable relative to the housing with a movement of the first part of the sealing element.

8. A liquid flow control method for conducting a filling operation for filling a metered quantity of liquid into a package, comprising:

feeding a liquid to a valve having an outflow piece with a plurality of passages, wherein all passages of the plurality of passages are closed by a first part and a second part of the valve in a closed position, the second part having an inner surface facing an outer surface of the first part, the first part being connected to the second part by a sleeve that is connected at an upper portion of the inner surface of the second part, the sleeve having a first sleeve portion that extends from the upper portion of the inner surface of the second part toward the outer surface of the first part and a second portion that extends upward from the second part along the outer surface of the first part, wherein an upper end of the second sleeve portion has a stop that cooperates with a shoulder that extends around a circumference of the first part, the sleeve allowing relative movement between the first part and the second part;

opening the valve from the closed position to a first open position in which passages closable by the first part are opened and passages closable by the second part are closed, wherein a gap formed between the outer surface of the first part and the inner surface of the second part defines a flow cross section between the valve and the outflow piece, a size of the flow cross section defined by the gap increasing as the first part is moved toward the first open position, and wherein the sleeve has a plurality of sleeve passages around a circumference thereof, the sleeve passages allowing the filling liquid to flow from an outer side to an inner side of the sleeve and through the gap between the first part and the second part;

opening the valve from the first open position to a second open position in which passages closable by the first part and the second part are opened, the flow cross section of the valve in the second open position being larger than the flow cross section of the valve in the first open position, whereby the valve allows a filling liquid to flow through the outflow piece and form a filling jet for the filling operation when the valve is not in the closed position, wherein the flow cross section of the valve in the first open position is encircled by an additional flow cross section of the valve in the second open position.

9. The liquid flow control method of claim 8, further comprising the step of controlling a velocity of the valve when moving the valve from the closed position to the first open position to create a pressure profile for the filling jet, the pressure profile being adapted to the filling liquid to be dispensed to minimize an impact of the liquid on the bottom of the package at the beginning of the filling operation.

* * * * *